United States Patent [19]

Harris

[11] 4,081,004

[45] Mar. 28, 1978

[54] WEIGHING HOPPER AND METHOD

[75] Inventor: Thomas C. Harris, Dickinson, N. Dak.

[73] Assignee: Olinkraft, Inc., P.O. Box 488, West Monroe, Louisiana 71291

[21] Appl. No.: 684,433

[22] Filed: May 7, 1976

[51] Int. Cl.[2] ..... B65B 1/06; B67D 5/06

[52] U.S. Cl. ..... 141/10; 141/93; 141/263; 141/286; 177/92; 222/533; 222/564

[58] Field of Search ..... 141/10, 54, 59, 67, 141/68, 71–75, 83, 93, 94, 105, 114, 166, 248, 263, 285, 286, 289, 313–317, 367, 392; 177/92, 93, 98, 99; 193/31 A; 222/145, 460, 533, 535, 564

[56] References Cited

U.S. PATENT DOCUMENTS

| | | | |
|---|---|---|---|
| 2,114,104 | 4/1938 | Driscoll et al. | 141/73 |
| 3,307,646 | 3/1967 | Hage et al. | 177/98 |
| 3,908,720 | 9/1975 | Garnett | 141/93 |

*Primary Examiner*—Richard E. Aegerter
*Assistant Examiner*—Frederick R. Schmidt

[57] ABSTRACT

An improved weighing hopper for use with a transition chute in a weighing scale of a packaging machine system is disclosed which provides for better control of the flowable materials in the weighing hopper and the transition chute and comprises forming the bottom surface of at least one weigh hopper and the transition chute into which the weigh hopper dumps its material with a slope that is equal to or greater than an angle of repose of the materials being handled in the weighing hopper. The use of the angle of repose or greater in combination with a controlled opening of the weigh hopper doors aids in controlling the flow of material and minimizes dust generation. Also disclosed are other related improvements to the weighing hopper which comprises positioning the weighing hopper and the transition chute in close proximity to each other and to the throat of the transition section for the purpose of minimizing the generation of dust within the weighing hopper by controlling the distance the material has to flow. A further related disclosure is contained for use with an improved weighing hopper for the purpose of control of suspended dust within the weighing hopper which comprises providing the transition chute with a vertically movable elongated divider member which may be positioned within the transition chute with the divider member providing a means for escape of entrapped air and dust as the bag is being filled. The various related improvements to the weighing hopper may be utilized singly or combined together to provide a much improved weighing hopper for use with a weighing scale of a packaging machine, and there is also disclosed various methods for controlling and collecting dust in the weighing hopper transition chute.

10 Claims, 6 Drawing Figures

WEIGHING HOPPER AND METHOD

BACKGROUND OF THE INVENTION

In the design of weighing systems for use in combination with packaging machines wherein a predetermined quantity of materials are weighed and then generally transported by gravity to the packaging machine for filling in a bag, the problem of controlling the flow of materials from the weighing station to the packaging machine is a critical one in order to try to have a smooth flow of materials so that dust problems are minimized.

Historically, the weighing scale manufacturer generally fulfilled his obligation when the desired net weight of the product was secured in the weighing container at which point the bottom of the container would be opened up and the product would be permitted to drop or rapidly flow to the bag in the bag packaging portion of the system passing through a void and having no restraint on the product or control of the product. From this it can be seen that many problems would be encountered especially in the control of the flow of the materials in the weighing hopper especially from the standpoint of generation of dust and removal of dust from the hopper transition chute.

It can be understood that an extreme dusty atmosphere can occur in the transition chute of a packaging system where the product drops anywhere from 5 to 10 feet from the bottom of the weighing scale to the bottom of the bag. The problem can be amplified when the product being packaged is, for example, manganese sulfate which is extremely fine and flows in the transition chute much like water flows in a pipe. Other types of materials which were troublesome from the standpoint of material flow and dust control were granular carbon and also granular celulose acetate.

SUMMARY OF THE INVENTION

In order to overcome the problems beforementioned, there has been provided by the subject invention a new and improved weighing hopper and design of the internal hopper construction for use in a bag packaging system which is designed to greatly improve the product flow and also to greatly reduce the amount of dust generated within the hopper and transition chute between the weighing station and the bag.

The design of the weighing hopper is such that the bottom of the weighing hopper is constructed at an angle equal to or greater than the angle of repose of the product to be weighed and the transition chute onto which the weighing hopper discharges is designed so that its slope matches the angle of the hopper bottom, there being a space between the weighing hopper and the transition chute to provide for balanced beam motion, but the space being designed so that the weighing hopper bottom and the transition chute are in close proximity to each other to minimize dust being generated at the point of transfer. The weighing hopper discharge gate is positioned in a vertical panel nearest the opening in the bottom of the transition chute and when in operation opens at a controlled rate so that the free-flowing product contained therein flows in a controlled fashion from the weighing hopper into the transition chute and down the transition chute to the throat of the transition chute where it can pass into the bag below. When thusly constructed and controlled, no more product arrives at the transition chute throat to the bag than can be handled by that throat. In order to further minimize dust generation, the transfer point from the weighing hopper to the transition chute is also placed in close proximity to the throat of the transition section so that, for example, where the throat section has a minimum width of "w" inches, the transfer point from the weighing hopper will be placed at least "w" inches upstream from the initiation of the throat section.

There is also further provided by the subject invention a vertically movable elongated divider which is designed to move into and out of the bag being filled with the divider providing a means for escape for entrapped air in the bag as the bag is being filled. There is also provided in conjunction with the movable divider a controlled sequence for moving the divider into the bag before the product is discharged and then removing the divider member from the bag as the product fills up in the bag with the divider member leading the product build up in the bag.

By the use of these related improvements along with others herein specified, there is provided by the subject new and novel invention a much improved flow control which provides minimum dust generation and accomplishes this through a sacrifice in speed of filling compared with formerly free-flowing granular products as have been heretofore packaged.

Accordingly, it is an object and advantage of the invention to provide an improved weighing hopper for use with a weighing scale of a packaging machine which utilizes an improved placement of the weighing hopper in conjunction with the transition chute and with a formation of the weighing hopper bottom and the transition chute at a slope which is equal to or greater than the angle of repose of the material being transferred in the weighing hopper.

Yet another object and advantage of the invention is to provide an improved flow control of materials in a weighing hopper wherein the weighing hopper is constructed in a generally rectangular shape having rounded corners thereby minimizing bridging of the flowable material at the corner structure.

Still yet another object and advantage of the invention is to provide a new and improved weighing hopper and dust collecting system for use with the weighing hopper of a packaging machine which comprises means for evacuating the dust and entrapped air from the transition chute where the dust is generated.

A further object and advantage of the invention is to provide a new and novel method for controlling and collecting dust in a weighing hopper transition chute which comprises generally among other things, the slowing down of the material being transferred in the weighing hopper by forming the weighing hopper and the transition chute at an angle equal to or greater than the angle of repose of the material being transferred in combination with controlling the rate of opening of the door of the weighing hopper.

Still yet another object and advantage of the invention is to provide an improved hopper for use with a weighing scale of a packaging system which is utilized for minimizing the generation of dust within the hopper by means of positioning the hopper and the transition chute in close proximity to each other and in close proximity to the throat of the transition chute thereby minimizing the generation of dust as the material flows from the weighing hopper to the transition chute and out the throat of the transition chute.

Yet another object and advantage of the invention is to provide a method for controlling and collecting dust in a weighting hopper transition chute which comprises among other things the steps of discharging the material from the weighing hopper to the transition chute by allowing it to drop a short distance to the transition chute and allowing it to drop a short distance from the weighing hopper to the throat section of the transition chute thereby generating the minimal amount of dust which can be readily handled with the dust collecting system.

A further object and advantage of the invention is to provide an improved hopper for use with a weighing scale of a bag packaging machine which is utilized for the control of suspended dust within the hopper which comprises the use of a vertically movable elongated divider member which may be positioned within the transition chute and the throat section of the transition chute and the bag in a predetermined manner to provide a means for escape of entrapped air as the bag is being filled.

Still yet another object and advantage of the invention is to provide a new and novel method for controlling and removing collected dust particles and entrapped air in a weighing hopper transition chute throat section of a bag packaging machine which comprises, among other things, the step of providing a movable elongated divider for vertical positioning within the bag proper in a predetermined manner and also sequentially removing the divider member from the bag as the product builds up in the bag with the divider member leading the product build up in the bag to thereby aid in removal of entrapped air and dust from the bag proper and from the throat section of the transition chute.

Still yet another object and advantage of the invention is to provide an improved hopper for use with a weighing scale of a packaging machine system which is positioned between a source of flowable materials in a package closing machine and is utilized for minimizing the generation of dust within the hopper and for controlling the flow of materials in the hopper in a predetermined manner by the utilization of the new and novel features of the subject invention either singly or in combination to thereby provide a much improved packaging system whereby extreme amounts of dust are able to be eliminated from the immediate area surrounding the weighing and packaging portion of the system.

These and other objects and advantages of the invention will become apparent from a review of the description of the preferred embodiment and from a review of the drawings showing the preferred embodiment as hereinafter described.

CROSS REFERENCES TO RELATED APPLICATIONS

U.S. Ser. No. 670,284, Filed Mar. 25, 1976, Entitled "Improved Transition Section for a Bag Filling Device and Method," now U.S. Pat. No. 4,049,028. Inventors: Thomas C. Harris and Charles E. DeCrane.

U.S. Ser. No. 673,849, Filed Apr. 5, 1976, Entitled "Bag Filling Apparatus With Air Contaminate Preventor, and still pending in the U.S. Patent Office", Inventor: Charles E. DeCrane.

DESCRIPTION OF THE PREFERRED EMBODIMENT

Figure 1:
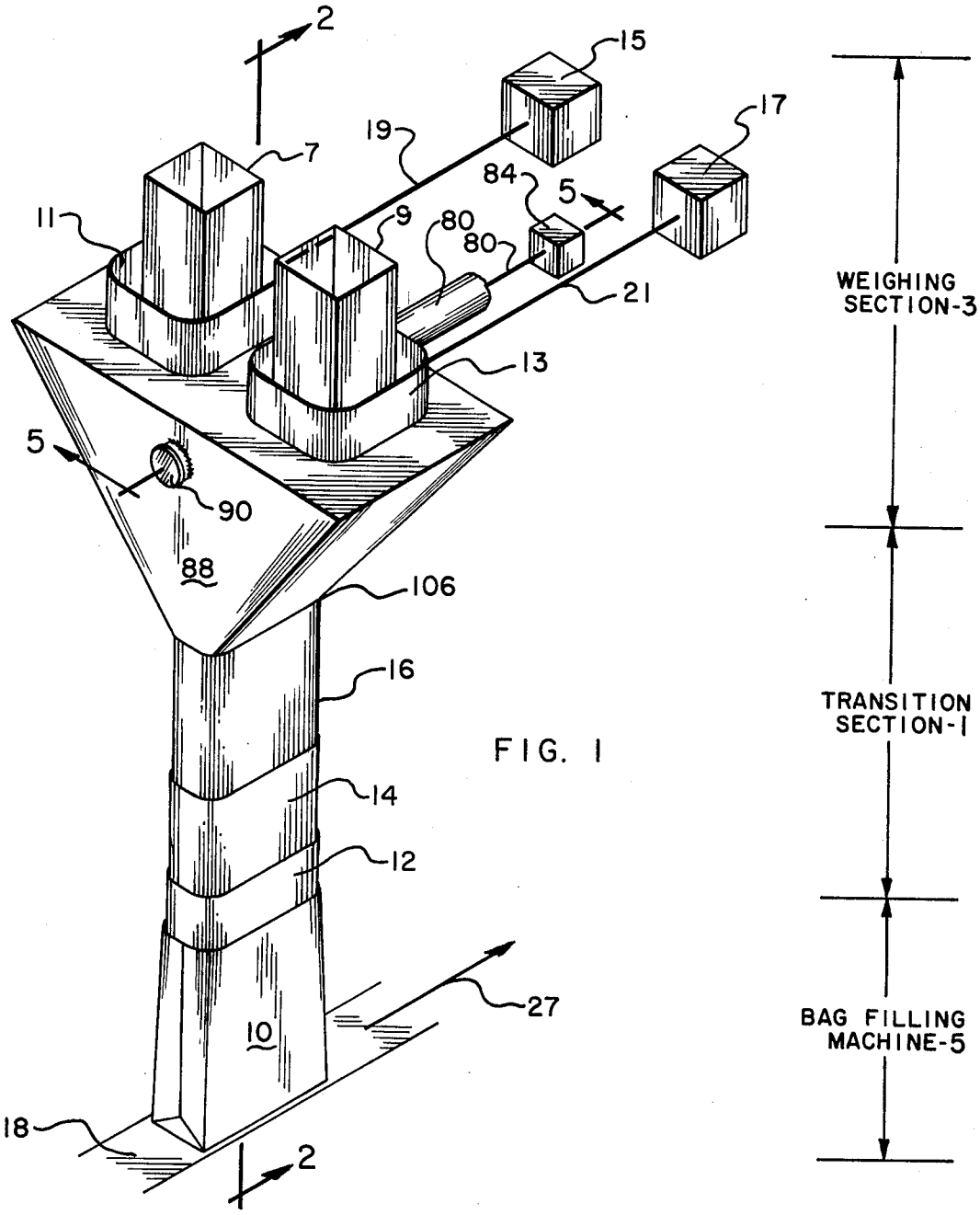
FIG. 1 is an isometric view of the subject device showing its position in relation to the weighing section of a bag filling machine system.

Referring now to the drawings in general and in particular to FIG. 1 of the drawing, there is shown an isometric view of the subject device showing its position in relation to the weighing section and the bag filling machine in a bag packaging line. The subject device comprises new improvements in the transition section 1 along with portions of the weighing section 3 when utilized with the bag filling machine 5. The standard weighing section 3 would comprise a plurality of material hoppers 7 and 9 which receive the material to be weighed for deposit in a plurality of weighing hoppers 11 and 13, which are suspended below the material hoppers 7 and 9 and are carried by the weighing scales 15 and 17 by means of the weighing arms 19 and 21.

In the weighing process, the material being weighed is ultimately dumped into the transition section 1 as the weighing scales 15 and 17 alternately weigh the material and allow it to be dumped into the section. As a result of this alternate dumping, the material to be packaged in the bag filling machine 5 is alternately dropped into the transition section 1 first from the weighing hopper 11 on the left of the device and then from the weighing hopper 13 on the right of the device and thereafter alternating back and forth between the two weighing hoppers. Material then passes through the transition section 1 which will be described more fully hereinafter in combination with the changes to the weighing section 3 and then on to the bag filling machine 5 which is designed to place a bag 10 in close proximity to the throat 16 of the transition section 1 for the purpose of filling the bag and then moving the bag in a direction shown by the arrow 27 to be ultimately shut by a closing machine in the packaging line. For purposes of brevity, the bag filling machine 5 has been omitted from the drawings and forms no portion of the subject invention. For examples of types of bag filling machine operations reference should be made to the following U.S. Patents assigned to Olinkraft, Inc.: U.S. Pat. Nos. 3,740,721; 3,755,986; and 3,796,300. These patents are representative of bag filling machine operations and are not represented to be the only types available on the market.

Due to the length of the transition section 1 between the weighing section 3 and the bag filling machine 5 it can be readily seen that the material to be packaged must ultimately drop a large given distance creating extreme conditions of dust and entrapped air within the system which it would be desirable to eliminate in order to have a relatively pollution-free atmosphere in the proximity of the bag packaging line. The applicant's new and novel device deals directly with that problem and with the problem of controlling the flow of materials through the weighing section and the transition section with a view to minimizing dust created in the weighing section and transition section and ultimately in the bag which is being held in place by the bag filling machine.

Figures 2, 3, 4:
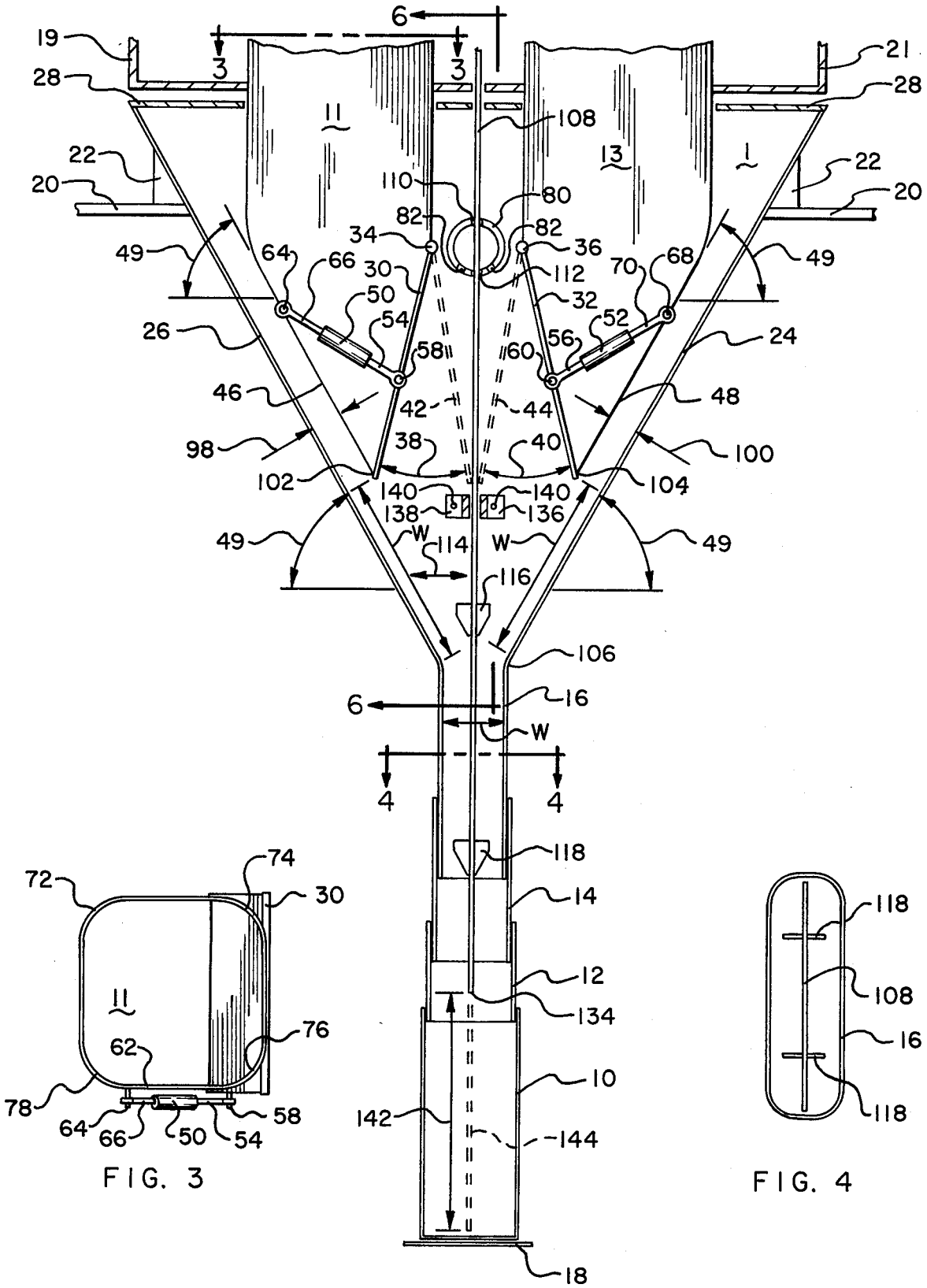
FIG. 2 is a sectional view taken along line 2—2 of FIG. 1 showing the placement of the weighing hoppers in the transition chute and the placement of the removable elongated divider member within the transition chute and throat section of the transition chute.
FIG. 3 is a sectional view taken along line 3—3 of FIG. 2 showing a cross section of one weighing hopper of the subject device.
FIG. 4 is a cross sectional view taken through line 4—4 of FIG. 2 showing a cross sectional view of the throat section of the transition chute of the device and showing the movable elongated divider member positioned within the throat section.

Referring now to FIG. 2 of the drawing, there is shown a cross section of the weighing section 3, transition 1 and the bag filling machine 5 wherein a bag 10 is positioned on a sleeve 12 which surrounds a second sleeve 14 which in turn is positioned on the throat 16 of the transition section 1. The bag 10 may be positioned on a dead plate 18 or may be held above the dead plate 18 depending upon the type of bag filling machine 5 being utilized, but ultimately will drop to the dead plate 18 to be transported down the filling line in the direction shown by the arrow 27 in FIG. 1 to be ultimately sewn shut or closed by some other means.

As beforementioned, the weighing hoppers 11 and 13 are carried by the weighing scales 15 and 17 by means of the weighing arms 19 and 21 and are suspended independently within the transition section 1 as shown in FIG. 2 of the drawings. The transition section 1 is fixedly attached to a stationary frame 20 by means of the gusset plate 22 which is welded to the sides 24 and 26 of the transition section 1. In order to prevent generated dust from passing out of the transition section 1 there is provided on the top of the transition section a cover 28 which may be fixedly attached to the top of the transition section 1 or may be removably attached as desired by the customer.

The transition section 1 comprises a downwardly and inclined transition chute formed by means of the sides 24 and 26 which originate below the source of flowable material and terminate at the package closing machine which may be a bag filling machine 5 or some other package closing machine. While in the preferred embodiment there are positioned, as shown in FIG. 2 of the drawing, two weighing hoppers 11 and 13, in broader aspects of the invention, the device would be formed with at least one weighing hopper fixedly attached to the movable scale frame or arm with the weighing hopper being partially positioned within the transition chute as shown in FIG. 2 of the drawing. The weighing hopper 11 as well as the weighing hopper 13 has formed thereon a downwardly hanging door 30 and 32 which is pivoted by means of the pins 34 and 36 so that the doors may be swung in the direction shown by the arrows 38 and 40 to the positions shown by the dashed lines 42 and 44 in a controlled sequence as will be described more fully hereinafter.

The weighing hoppers 11 and 13 are formed with a downwardly and inwardly sloped bottom surface 46 and 48 which terminates at the doors 30 and 32 and is in close proximity to the inclined transition chute sides 24 and 26. The transition chute sides 24 and 26 and the bottom surfaces 46 and 48 of the weighing hoppers 11 and 13 are formed so that the slope of the transition chute and the bottom surfaces are approximately equal to or greater than the angle of repose of the materials being handled in the weighing hoppers. The purpose of this controlled slope will be described more fully hereinafter, but it should be sufficient to say at this time that for example, when the flowable material in the weighing hoppers is granular carbon, then it has been found from experimentation that the transition chute sides 24 and 26 and the weighing hopper bottom surfaces 46 and 48 would be sloped approximately 55° relative to the horizon. In a similar manner, it has been found from experimentation that when the flowable material is manganese sulfate, then the transition chute sides 24 and 26 and the weighing hopper bottom surfaces 46 and 48 would be sloped approximately in the range of 45° to 50° relative to the horizon as shown by the arrows 49.

In order to control the opening of the doors 30 and 32 there is provided for each door a power cylinder 50 and 52 having a connecting rod 54 and 56 pivotably attached to the doors 30 and 32 by means of the pins 58 and 60.

By referring to FIG. 3 of the drawing, it can be seen that the power cylinder 50 would be mounted on the outside of the weighing hopper 11 and would be mounted on the side 62 of the weighing hopper 11 by means of the pin 64 and the arm 66. In a similar manner, the power cylinder 52 would also be mounted outside of the weighing hopper 13 by means of the pin 68 in combination with the arm 70. While not shown in the drawing, it should become obvious that the power cylinders 50 and 52 could be controlled pneumatically or hydraulically or by other means well known in the art and would be utilized to open and close the doors 30 and 32 in a desired controlled sequence to allow the materials to flow on the bottom surfaces 46 and 48 and out of the door to be deposited in the transition chute in a controlled manner.

In order to provide still better control of the materials in the weighing hoppers 11 and 13, and as shown in FIG. 3 of the drawing, the weighing hoppers 11 and 13 may be provided with rounded corners 72, 74, 76 and 78 so that bridging or build-up of the material does not occur in the corner section of the weighing hoppers.

Figure 5:
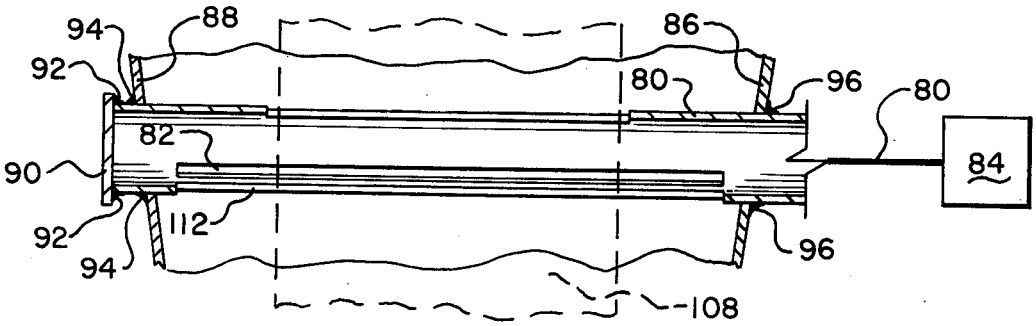
FIG. 5 is a cross sectional view taken along line 5—5 of FIG. 1 showing the means for exhausting the entrapped air and dust from the transition chute.

Positioned in the upper portion of the transition section 1 is an exhaust duct 80 shown generally in FIG. 2 of the drawing and shown more specifically in FIG. 5 of the drawing. The exhaust duct 80 extends into the transition section and is positioned between the weighing hoppers 11 and 13 and has formed in the bottom portion thereof a plurality of elongated open slots 82 which are used for evacuating dust and air from the interior of the transition section through the duct 80 and out of the system by means of the exhaust fan 84 shown generally in FIG. 5 and FIG. 1 of the drawing. As shown in the same figures of the drawings, the exhaust duct 80 is positioned in an opening in the side 86 of the transition section and terminates in an opening in the side 88 of the transition section where it is capped by means of a plate 90 which is welded in place by memns of the weld 92 with the exhaust duct 80 being welded to the side 88 by means of the weld 94 and being welded to the side 86 by means of the weld 96.

When constructed thusly, the formation of the bottom surfaces 46 and 48 of the weighing hoppers 11 and 13 along with the formation of the sides 24 and 26 of the transition chute section 1 in combination with the controlled opening of the doors 30 and 32 forms a new and improved method for controlling the generation of dust in the weighing hopper transition chute. By formation of the bottom surfaces 46 and 48 and sides 24 and 26 at approximately equal to or greater than the angle of repose of the material, the material is somewhat slowed down and may be further slowed down by a delayed opening of the doors 30 and 32 with the slowing down being to a rate that can be easily controlled and handled by the packaging machine so that only a given amount of charge of materials will subsequently pass from the weighing hopper to the transition chute and into the throat section 16 of the transition chute. This controlled flow and rate of flow will thereby aid in minimizing generation of unusually large amounts of dust in the transition chute. When such method and structure is used in combination with the exhaust fan 84 connected to the exhaust duct 80 as shown in FIG. 5 of the drawing, there is then provided a much improved method for controlling and collecting the dust in the transition chute.

In order to improve still further the minimization of generation of dust, there may be provided in the placement of the weighing hoppers 11 and 13 a controlled distance between the bottom surfaces 46 and 48 of the weighing hoppers 11 and 13 in relation to the sides 26 and 24 of the transition section 1. Since the flowable charge in the weighing hoppers 11 and 13 must pass to the transition chute sides 26 and 24, it has been found that the generation of dust can be also minimized whenever the bottom surfaces 46 and 48 are positioned in close proximity to the sides 26 and 24 of the transition section 1. This distance is shown by the arrows 98 and 100 in FIG. 2 of the drawing, and would be preferably such that the distance 98 and 100 would be within at least approximately $\frac{1}{4}$ of an inch to 1 inch for a large portion of the materials generally handled in the packaging system.

It has also been found that a further step may be taken in minimizing the generation of dust by placement of the intersection of the doors 30 and 32 with the bottom surfaces 46 and 48 in close proximity to the throat section of the transition chute. That is to say the point shown by the numeral 102 and 104 should be preferably placed at least "*w*" inches from the initiation of the elongated throat section shown generally by the numeral 106 whenever the throat section is formed with a dimension of "*w*" inches, also. That is to say that the points 102 and 104 should be positioned as close as possible to the point 106 in order to minimize the distance that the flowable materials have to travel in the transition chute after being deposited in the transition chute by virtue of the controlled opening of the doors 30 and 32 until the materials pass through the throat of the transition section shown by the numeral 106.

When formed thusly, it can be seen that there is provided a new method with the new and novel structure placement for controlling and collecting the dust in the weighing hopper whenever the bottom surface of the weighing hoppers 11 and 13 are positioned in close proximity to the transition chute sides 26 and 24 and also in close proximity to the throat section 106 of the transition chute. When utilized thusly in combination with the controlled opening of the weighing hopper doors 30 and 32 it can be seen that the material discharge from the weighing hoppers is allowed to flow over the bottom surface of the weighing hoppers and out of the doors of the weighing hopper dropping a relatively short distance to the transition chute and dropping a relatively short distance from the door of the weighing hopper to the throat section thereby generating a minimal amount of dust. When utilized in combination with the new and novel formation of the weighing hopper bottom surfaces 46 and 48 and the transition chute sides 26 and 24 at approximately equal to or greater than the angle of repose of the materials being handled in the weighing hopper, it can be seen that there is provided still further improved means and structure for controlling and collecting the dust in the weighing hopper transition chute by strictly controlling the flow of the materials in the weighing hoppers as they pass from the weighing hoppers to the transition chute and further as they pass down the transition chute to the throat section of the transition chute.

Figure 6:
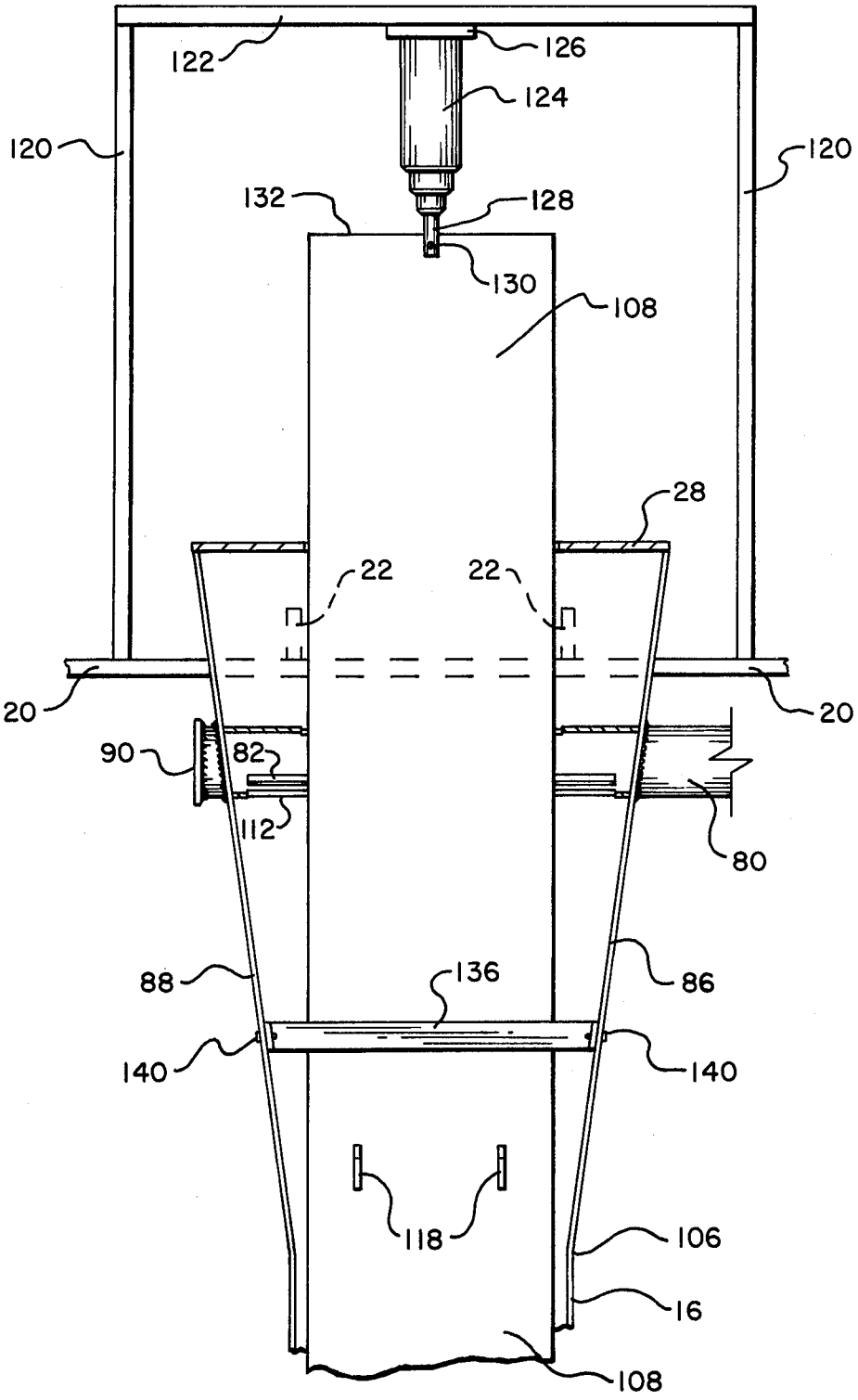
FIG. 6 is a cross sectional view of the upper portion of the transition chute taken along line 6—6 of FIG. 2 showing the means for moving the divider member in position in the transition chute throat section and in the bag.

Referring again to FIG. 2 of the drawing and to FIGS. 4 and 6, there can be seen still further improvements in the control of the flowable material in the transition section whereby there is positioned in the central portion of the transition section a movable elongated divider member 108 which is movably mounted in a vertical direction on the stationary frame 20 and is designed for positioning within the transition section and the throat 16 as well as within the bag 10 in a predetermined manner to provide a means for escape of entrapped air from the throat section 16 and the bag 10. The movable elongated divider member 108 is shown in FIG. 2 as passing through the exhaust duct 80, through the opening 110 in the upper portion of the exhaust duct 80, and through the opening 112 in the lower portion of the exhaust duct. The size of the openings 110 and 112 would be sufficiently large to allow the movably elongated divider member 108 to move within the exhaust duct 80 and at the same time to be guided by the duct openings as it moves vertically in the openings.

The general concept of the use of a divider member in the transition chute is taught in the applicant's co-pending application before described Ser. No. 670,284, filed Mar. 25, 1976, and entitled "Improved Transition Section For A Bag Filling Device and Method," filed in the names of Thomas C. Harris and Charles E. DeCrane. The vertically movable elongated divider member 108 now being described is considered an improvement over that concept and for a clear description of the use of a divider member to provide two paths of air flow, reference should be made to that application before reviewing the present improvement and how it is utilized in the filling of a bag.

The movable elongated divider member 108 may be constructed of a relatively thin metal plate so that it is able to move back and forth in the direction shown by the arrow 114 as shown in FIG. 2 of the drawing and would be designed to have a series of stops 116 and 118 formed on the divider member 108 to prevent the divider member from completely positioning itself on one side or the other of the throat 16 thereby in effect closing off one of the flow paths for air and dust. The stop 116 and 118 may be constructed of an elongated plate or plates which may be welded to the divider member 108 by means well known in the art and in the location as shown in FIG. 4 of the drawings.

Referring now to FIG. 6 of the drawing there is shown a preferred method for mounting of the movable elongated divider member 108 within the transition section 1 and the means for moving the divider member vertically as before mentioned. The stationary frame 20 may have a vertical frame 120 rigidly attached thereto by means well known in the art with a horizontal frame 122 also rigidly attached thereto. The horizontal frame 122 may have fixedly attached thereto a telescoping cylinder 124 which may be fastened to the horizontal frame 122 by means of the plate 126 and held thereto by means of bolts or other suitable holding means. The telescoping cylinder 124 has attached thereto a connecting rod 128 which connects to the pin 130 which is in turn positioned through the upper portion 132 of the movable elongated divider member 108.

The telescoping cylinder 124 may be pneumatically or hydraulically driven by means well known in the art or by other means and would serve to position the lower portion 134 of the movable elongated divider member 108 in the throat section 106 and in the bag 10 as shown in FIG. 2 of the drawing. Since the movable elongated divider member 108 would be constructed of a thin relatively flexible material such as sheet steel or the like, it may be advantageous to provide for additional means for guiding the elongated divider member 108 as it is vertically positioned in the bag. As has been before described and as is shown in FIG. 2 of the drawing, the elongated divider member 108 is guided somewhat by means of the opening 110 and the opening 112 in the exhaust duct 80 and may also be guided by means of a bar 136 and a bar 138 which are fixedly mounted within the transition section 1 and are held in place by means of a plurality of screws 140 which are mounted in the sides 86 and 88 of the transition section 1. When formed thusly, the bars 136 and 138 form additional guides for the vertically movable elongated divider member 108.

When utilizing the movable elongated divider member 108 as a means for aiding in the removal of dust from the throat section 106 and from the bag 10, it should be noted that the movable elongated divider member 108 would be positioned in the bag 10 by means of the telescoping cylinder 124 being activated to move the lower portion 134 of the divider member 108 into the bag 10 before the product is discharged from the weighing hoppers 11 and 13 into the bag. The amount of movement of the lower portion 134 is shown in FIG. 2 of the drawing by the arrow 142 and the movement of the lower portion 134 of the elongated divider member 108 is shown by the dashed lines 144 also in FIG. 2 of the drawing.

After the movable elongated divider member 108 is positioned in the bag 10 as shown in FIG. 2 of the drawing, the product is discharged from the weighing hoppers 11 and 12 as has been before mentioned and as the product builds up in the bag 10, the movable elongated divider member 108 would be withdrawn from the bag 10 leading the product buildup of materials in the bag with the telescoping cylinder 124 being utilized to withdraw the divider member 108 from the bag. When being withdrawn in this manner, the product is able to build up and fill the bag and not interfere with the upward and outward movement of the elongated divider member from the bag while still being able to provide for paths for the flow of product downwardly into the bag and for the flow upwardly of entrapped air and generated dust from the bag and from the throat section of the transition chute.

When utilized thusly, the movable elongated divider member 108 in combination with the exhaust fan 84 serves as a much improved method for controlling and removing collected dust particles and entrapped air from the internal portions of the device. When the movable elongated divider member 108 in combination with the exhaust fan 104 is used with the hereinbefore described improved transition chute and weighing hopper improvement, there is provided an improved hopper for use with the weighing scale of a packaging machine system which serves as a new and novel means for minimizing the generation of dust within the hopper structure.

From the foregoing it can be seen that there has been provided a new and novel improved weighing hopper and method which provides for better control of the flowable materials in the weighing hopper and in the transition chute and which is utilized for the minimization of the generation of dust within the weighing hopper and within the transition chute and throat section and bag by the various interrelated improvements within the transition section. The various improvements may be utilized singly or combined together to provide much improved weighing hopper structures for use with weighing scales and while the preferred embodiment has been shown by way of illustration only, the invention is not to be limited to the exact embodiment shown since it should become obvious from a study of the drawings and from a review of the specification that many changes may be made in the various structure and parts of the device and in the steps of the method without departing from the spirit and scope of the invention.

Having described my invention, I claim:

1. An improved hopper arrangement for use with a weighing scale of a bag packaging machine for filling a bag and for control of dust as the bag is being filled comprising:

(a) a first stationary frame; chute fixedly attached to said first stationary frame, said transition chute having formed thereon at the lower portion thereof, a vertically elongated throat section for being inserted into an open top of the bag;

(c) at least one weigh hopper associated with the weighing scale and extending into said transition chute;

(d) a movable elongated divider member movably mounted on said first frame within said transition chute with said at least one weigh hopper positioned on one side of said divider member, said divider member extending through said throat section;

(e) means for positioning the divider member intermediately in the throat section to provide a first path on one side of the divider member for materials to fall into the bag and to provide a second path on the other side of the divider member for allowing escape of air and dust as the bag is being filled;

(f) means, associated with said transition chute for exhausting the interior of said transition chute, said throat section and the bag; and (g) means movably mounting said elongated divider member on said first frame for moving the divider member between lowered and raised positions as the bag is being filled, said divider member in said lowered position extending into the bag, and said divider member in said raised position being wholly above the bag.

2. The hopper arrangement as defined in claim 1 wherein said divider member moving means includes a power actuated cylinder.

3. A method for controlling and removing dust particles of a material discharged from a weighing hopper into a bag in a bag packaging machine comprising the steps of:

(a) positioning a bottom end of a vertically elongated throat section on a lower portion of a transition chute within an open top of the bag;

(b) discharging the material from the weighing hopper into the transition chute on only one side of a movable elongated divider member extending vertically within said transition chute and through said throat section whereby said material falls into the bag (c) maintaining said movable elongated divider member intermediately within said transition chute and said throat section to provide a first path on one side of said divider member for allowing the material to fall into the bag and to provide a second path on the opposite side of said divider member for allowing escape of air and dust from the bag as the bag is being filled with the material;

(d) moving said divider member into and out of the bag in a predetermined manner to aid in removal of air and dust; and (e) exhausting air carrying dust from the bag, the throat section and the transistion chute.

4. The method as defined in claim 3 wherein the divider member is moved into and out of the bag in the following predetermined sequence:

(1) moving the divider member into the bag before the material is discharged into the bag;

(2) discharging the material into the bag; and (3) removing the divider member from the bag as the material builds up in the bag with the removal of the divider member leading the material buildup in the bag.

5. An improved hopper arrangement for use with a weighing scale of a bag packaging machine system which is positioned between a source of flowable materials having a predetermined angle of repose and a bag package closing machine and is utilized for minimizing the generation of dust within the hopper arrangement comprising:

(a) a first stationary frame;

(b) a downwardly and inwardly inclined transition chute fixedly attached to said first stationary frame, said transition chute originating below the source of flowable materials and terminating at the package closing machine, said chute having formed thereon at the lower portion thereof a vertically elongated throat section, said throat section serving as a means to be inserted into an open top of the bag;

(c) a second movable scale frame fixedly attached to the weighing scale and positioned above said transition chute;

(d) a divider member extending vertically in said transition chute and through said elongated throat section;

(e) means for positioning said divider member intermediately in said transition chute through said throat section so as to provide a first path on one side of the divider member for permitting material to fall into the bag and to provide a second path on the other side of the divider member for allowing escape of air and dust from the bag;

(f) at least one weigh hopper fixedly attached to said second movable scale frame and positioned partially within said transition chute on one side of said divider member;

(1) said weigh hopper having formed thereon a downwardly hanging door hinged at its top so as to open by swinging inward toward said divider member;

(2) said weigh hopper having formed thereon a downwardly and inwardly sloped bottom surface terminating at said door and in close proximity to the inclined transition chute, said chute and said bottom surface being formed so that the slope of said chute and said bottom surface is approximately equal to or greater than the angle of repose of the materials being handled in the weighing hopper;

(3) the intersection of said door and said sloped bottom surface being in close proximity to the initiation of the elongated throat section;

(4) means, associated with said door, for swinging said door open and closed to allow the materials to flow on said bottom surface and out of said door and to be deposited in the transition chute; and (5) said close proximities of the termination of said bottom surface of the weigh hopper to the transition chute and to the initiation of the throat section in combination with the inward swinging door and slopes of said transition chute and said bottom surface of the weighing hopper being selected to control the flow of the material to minimize the amount of dust generated by the flow of the material.

6. The hopper arrangement as defined in claim 5 further comprising:

(e) means movably mounting said elongated divider member on said first frame for vertical movement within said transition chute, said throat section and said bag in a predetermined manner to provide a means for escape of entrapped air as the bag is being filled.

7. The hopper arrangement as defined in claim 6 further comprising (f) means, associated with said transition chute, for exhausting the interior of said transition chute, said throat section and said bag.

8. A method for controlling and collecting dust in a weighing hopper transition chute of a bag packaging machine system for a source of flowable materials having a predetermined angle of repose comprising the steps of:

(a) providing at least one weigh hopper suspended within the transition chute;

(b) providing a bottom surface on said weigh hopper that is sloped at approximately the slope of the transition chute, both slopes being approximately equal to or greater than the angle of repose of the materials being handled in the weighing hopper;

(c) providing the transition chute with a downwardly extending throat section;

(d) providing a bottom surface on said weigh hopper that is positioned in close proximity to the transition chute, the termination of the bottom surface of said weigh hopper being also in close proximity to the initiation of the throat section on the transition chute;

(e) providing a vertically hanging door on the weigh hopper to control the discharge of the material from the weigh hopper;

(f) opening the door by swinging the door inward toward the center of the transistion chute;

(g) discharging the material from the weigh hopper by allowing it to flow over the bottom surface and out the door, said discharging being only on one side of an elongated divider member extending vertically in the transition chute through the throat section, the slope on the bottom surface in combination with the controlled discharge through the door serving to control the flow of the material to a rate that can be easily controlled and handled by the packaging machine without generating an unusually large amount of dust;

(h) dropping the material a short distance to the transition chute and a short distance from the door to the initation of the throat section so as to minimize the generation of dust;

(i) maintaining the elongated divider member centrally within the transition chute through the throat section so as to provide a first path on the one side of the elongated divider member for passing the discharged material into the bag and to provide a second path on the other side of the elongated divider member for passing air and dust from the bag; and (j) exhausting the minimal amount of dust from the transition chute, the throat section and the bag.

9. The method as defined in claim 8 further comprising the step of:

(k) moving the elongated divider member vertically within said transition chute and said throat section and into and out of said bag in a predetermined manner as the bag is being filled with the material.

10. The method as defined in claim 9 wherein the predetermined manner of moving said divider member into and out of said bag comprises the steps of:

(1) moving the divider member into the bag before the material is discharged into the bag;

(2) discharging the material into the bag; and (3) removing the divider member from the bag as the material builds up in the bag with the removal of the divider member leading the material buildup in the bag.

* * * * *

UNITED STATES PATENT OFFICE

CERTIFICATE OF CORRECTION

Patent No. 4,081,004 Dated March 28, 1978

Inventor(s) Thomas C. Harris

It is certified that error appears in the above-identified patent and that said Letters Patent are hereby corrected as shown below:

In the Abstract, Column 2, Line 6, after the word "greater" insert a comma -- , --.

Column 6, Line 58, delete "memns" and insert in place thereof -- means --.

Column 9, Line 53, after the word "manner" insert the following: -- by leading the material buildup, --.

Column 10, Line 31, after the " ; ", begin a new paragraph as follows -- (b) a downwardly and inwardly inclined transition --.

Column 10, Line 40, delete "said".

Column 10, Line 62, after the word "cylinder" insert -- attached thereto. --.

Column 12, Line 31, omit "(e)" and insert in place thereof -- (g) --.

Column 12, Line 39, omit "(f)" and insert in place thereof -- (h) --.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*

--